US008359980B2

(12) United States Patent
Beck

(10) Patent No.: US 8,359,980 B2
(45) Date of Patent: Jan. 29, 2013

(54) CABLE RAILWAY SYSTEM

(75) Inventor: Markus Beck, Fussach (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 13/211,352

(22) Filed: Aug. 17, 2011

(65) Prior Publication Data

US 2012/0090494 A1 Apr. 19, 2012

(30) Foreign Application Priority Data

Oct. 18, 2010 (AT) ..... A 1729/2010

(51) Int. Cl.
*B61B 7/00* (2006.01)

(52) U.S. Cl. ..... 104/178; 104/180; 104/112; 104/168

(58) Field of Classification Search ..... 104/87, 104/178, 180, 112, 165, 173.1, 197, 200, 104/202, 113, 115, 229–234; 105/30, 32, 105/33, 73

See application file for complete search history.

(56) References Cited

U.S. PATENT DOCUMENTS 3,769,914 A * 11/1973 Lorinet et al. ..... 104/287
3,859,926 A * 1/1975 Strohschein ..... 104/178
3,934,517 A * 1/1976 Hirsig ..... 104/173.1
4,185,562 A * 1/1980 Hatori et al. ..... 105/152
4,942,823 A * 7/1990 Meindl ..... 104/178
5,690,031 A * 11/1997 Bach et al. ..... 104/168
6,321,658 B1 * 11/2001 Pabst et al. ..... 104/202
6,431,080 B1 * 8/2002 Eisendle et al. ..... 104/178
6,494,141 B2 * 12/2002 Montambault et al. ..... 104/112
6,543,366 B2 * 4/2003 Pabst et al. ..... 104/202
7,404,360 B2 * 7/2008 Cylvick ..... 104/112
7,410,068 B1 * 8/2008 Andreetto ..... 212/94
7,549,377 B2 * 6/2009 Pabst ..... 104/180
7,637,213 B2 * 12/2009 Cylvick ..... 104/112
7,640,863 B2 * 1/2010 Minges ..... 104/130.03
7,650,843 B2 * 1/2010 Minges ..... 104/178
7,743,711 B2 * 6/2010 Mugnier ..... 104/168
7,878,122 B2 * 2/2011 Mugnier ..... 104/168
7,891,300 B2 * 2/2011 Pabst et al. ..... 104/178
2004/0168605 A1 * 9/2004 Minges ..... 104/178
2006/0288901 A1 * 12/2006 Cylvick ..... 104/112
2007/0169660 A1 * 7/2007 Pabst ..... 104/196
2007/0227394 A1 * 10/2007 Mugnier ..... 104/180
2008/0115689 A1 * 5/2008 Heil et al. ..... 104/242
2009/0165666 A1 * 7/2009 Pabst et al. ..... 104/112
2010/0300322 A1 * 12/2010 Cylvick ..... 104/112
2012/0042803 A1 * 2/2012 Beck ..... 104/112
2012/0090494 A1 * 4/2012 Beck ..... 104/87

* cited by examiner

*Primary Examiner* — Jason C Smith

(74) *Attorney, Agent, or Firm* — Laurence A. Greenberg; Werner H. Stemer; Ralph E. Locher

(57) ABSTRACT

A cable railway system has a conveying cable, which in the two end stations of the system is guided over a respective deflection pulley. Transport vehicles, which can be coupled to the conveying cable and are configured with a clamping device and with a running gear. The vehicles are coupled to the conveying cable along the route and are guided in the stations by way of the running gear along guide rails. There, the passengers disembark and board. The movement of the vehicles in the stations is governed by control tires, which are drivingly coupled to one another by gear mechanisms. The drive power of the control tires is taken from at least one support roller for the conveying cable, which support roller is located in the station. The support roller for the conveying cable via which the drive of the control tires is derived from the conveying cable by way of at least one drive belt is elastically mounted on a rigidly fastened axle.

9 Claims, 5 Drawing Sheets

CABLE RAILWAY SYSTEM

CROSS-REFERENCE TO RELATED APPLICATION

This application claims the priority, under 35 U.S.C. §119, of Austrian patent application A1729/2010, filed Oct. 18, 2010; the prior application is herewith incorporated by reference in its entirety.

BACKGROUND OF THE INVENTION

Field of the Invention

The present invention relates to a cable railway system having a conveying cable, which in the two terminal stations of the system is guided over a respective deflection pulley, or head wheel. The system includes vehicles, such as gondolas, cars or chairs, which can be coupled to the conveying cable and are configured with a clamping device and with a running gear. The vehicles are coupled to the conveying cable along the route and decoupled from the conveying cable at the entrances into the stations, they are guided by way of the running gear along guide rails through the stations, whereupon they are boarded and exited by the passengers and at the exit from the stations are reconnected to the conveying cable. The movement of the vehicles in the stations is realized by means of control tires, namely decelerating tires, conveying tires and accelerating tires, which are drivingly coupled to one another by gear mechanisms and by which the speed of the vehicles, following their decoupling from the conveying cable, is reduced by the decelerating tires, and also the vehicles are moved by means of the conveying tires at low speed through the embarkation and disembarkation area for the passengers, in which the passengers disembark from them or board. Then the speed of the vehicles is increased by means of the accelerating tires, whereupon they are reconnected to the conveying cable and are conveyed out of the station. The drive of the control tires is realized by the conveying cable via at least one support roller for the conveying cable, which support roller is located in the respective station.

In cable railway systems of this type, in which the drive power for the control tires is derived from the conveying cable via at least one support roller for the conveying cable, this at least one support roller is mounted on an axle rigidly fastened to the load-bearing structure. Due to the vertical movements of the conveying cable, however, different loads arise upon this at least one support roller, which loads give rise to increased wear upon this at least one support roller. Furthermore, vibrations and shocks which are caused by the conveying cable hereby make their way into the load-bearing structure of the station, so that the load-bearing structure has to be designed suitably strengthened. Since the further support rollers which, where necessary, are provided on the load-bearing structure and from which no drive is derived are adjustable in height in relation to the load-bearing structure, by being mounted, for example, on rockers, the cited drawbacks are not brought about by these further support rollers.

SUMMARY OF THE INVENTION

It is accordingly an object of the invention to provide a cable railway system, which overcomes the above-mentioned disadvantages of the heretofore-known devices and methods of this general type and which substantially reduces the loads, vibrations and shocks which make their way onto the load-bearing structure through the conveying cable, via the at least one support roller from which the drive for the control tires is derived.

With the foregoing and other objects in view there is provided, in accordance with the invention, a cable railway system, comprising:

- a conveying cable extending between two terminal stations and guided about respective headwheels in the stations;
- transport vehicles each having a clamping device for coupling to the conveying cable and a running gear, wherein the vehicles are coupled to the conveying cable en route between the stations and decoupled from the conveying cable upon entering the stations;
- guide rails disposed for guiding the vehicles with the running gears through the stations, for enabling passengers to disembark from and board the vehicles, and whereupon the vehicles are once more coupled to the conveying cable for exiting the respective station;
- a plurality of control tires disposed in the stations effecting a movement of the vehicles in the stations, the control tires including decelerating tires, conveying tires, and accelerating tires, drivingly coupled to one another by gear mechanisms and disposed such that a speed of the vehicles, after having been decoupled from the conveying cable, is reduced by the decelerating tires, the vehicles are moved by the conveying tires at a relatively low speed through an embarkation and disembarkation area for the passengers, and the speed of the vehicles is increased by the accelerating tires, whereupon the vehicles are reconnected to the conveying cable; and
- a support roller disposed to support the conveying cable at the station and at least one drive belt connected between the support roller and the control tires for driving the control tires, the support roller being elastically mounted on a rigidly fastened axle.

In other words, the objects are achieved according to the invention by virtue of the fact that the at least one of those support rollers for the conveying cable via which the drive of the control tires is derived from the conveying cable by means of at least one drive belt is elastically mounted on a rigidly fastened axle.

Preferably, an elastic sleeve is present between a ring bearing, located on a pivot, and a support ring for the conveying cable. The outer bearing ring of the ring bearing can here be configured with a supporting surface for the at least one drive belt, or the support ring for the conveying cable can be configured with a continuation over which the at least one drive belt is placed. According to a further embodiment, an annular elastic sleeve is mounted on the pivot fastened to the load-bearing structure, and a support bearing and a support ring for the conveying cable and for the at least one drive belt are located radially outside this sleeve.

Other features which are considered as characteristic for the invention are set forth in the appended claims.

Although the invention is illustrated and described herein as embodied in a cable railway system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
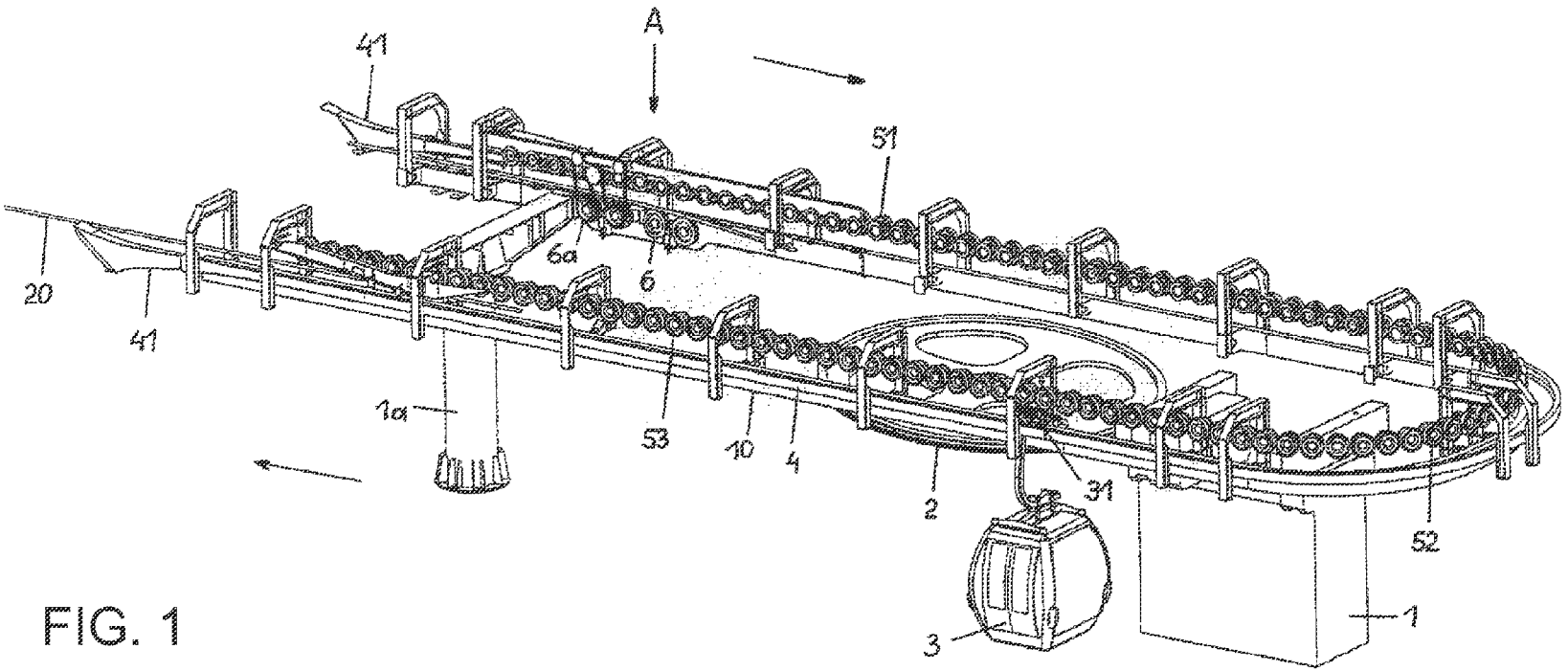
FIG. 1 is an axonometric view of one of the terminal stations of an aerial cable railway system according to the invention.

Referring now to the figures of the drawing in detail and first, particularly, to FIG. 1 thereof, there is shown a terminal station with a load-bearing structure 10, which is supported by pillars 1 and 1*a* and on which a deflection pulley 2, also referred to as a headwheel, via which a conveying cable 20 is guided, is mounted on an approximately vertical axle. During running of the cable railway system, the conveying cable 20 is circulated at a speed of, for example, 6 m/sec by means of a drive motor located preferably in the top station. To the conveying cable 20, transport vehicles 3, in the present case gondolas, can be coupled. On route, the vehicles 3 are coupled to the conveying cable 20. At the entrance into the station, the vehicles 3 are decoupled from the conveying cable 20 and are moved by means of a running gear 31 along a guide rail 4 through the station. At the exit from the station, the vehicles 3 are reconnected to the conveying cable 20. The guide rail 4 is configured at its two free ends with inlet funnels 41. The motional direction of the vehicles 3 is indicated by arrows.

The movement of the vehicles 3 through the station is served by control tires 51, 52 and 53, which are mounted on the load-bearing structure 10 and which are drivingly coupled to one another by gear mechanisms. The control tires 51 of a first group, located at the entrance into the station, serve as decelerating tires, by means of which the speed of the vehicles 3 decoupled from the conveying cable 20 is reduced from, for example, 6 m/sec to, for example, 0.3 m/sec. The following control tires 52 of a second group are conveying tires, by which the vehicles 3 are guided at the speed of, for example, 0.3 m/sec through the embarkation and disembarkation area of the station, in which they are boarded and exited by the passengers. By the third group of control tires 53, which serve as accelerating tires, the speed of the vehicles 3 is increased back up to, for example, 6 m/sec, whereupon the vehicles 3, at the exit from the station, are coupled up to the conveying cable 20 circulating at this speed.

The conveying cable 20 is guided over a multiplicity of support rollers 6 which are mounted on the load-bearing structure 10 and are rotated by the conveying cable 20. The control tires 51, 52 and 53 are driven by virtue of being torsionally coupled with at least a further support roller 6*a* for the conveying cable 20.

Figure 2:
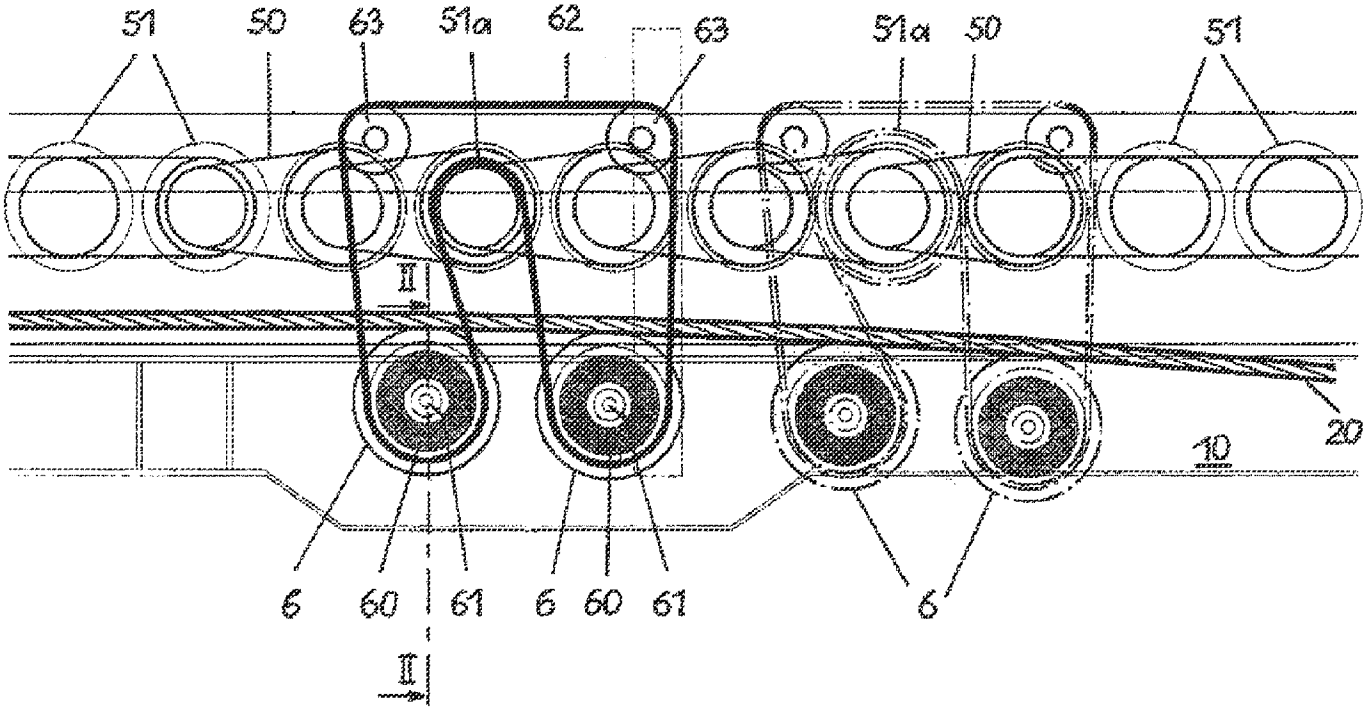
FIG. 2 is a detail A of FIG. 1 in side view and in enlarged representation in relation to the overview in FIG. 1.

As can be seen from FIG. 2, in a cable railway system according to the invention the drive for the control tires 51, 52 and 53 is derived from the conveying cable 20 through the provision of at least one drive belt 62, which is placed over two support rollers 6*a* for the conveying cable 20, furthermore over two deflection rollers 63 and also over one of the control tires 51*a*. The support rollers 6*a* are here mounted on pivots 61 rigidly fastened to the load-bearing structure 10. The control tires 51 are drivingly coupled to one another by means of transmission belts 50, which transmission belts 50 can effect a speed change in the rotational speed of the control tires 51, 52 and 53. That control tire 51*a* over which the transmission belt 62 is placed here serves as the drive for all other control tires 51, 52 and 53, or at least for a group of the control tires 51, 52 and 53.

As is indicated in FIG. 2, a plurality of groups of support rollers 6*a* can also serve as the drive for the control tires 51, 52 and 53. Similarly, the drive for the control tires 51, 52 and 53 can also be derived from a single support roller 6*a* for the conveying cable 20.

In order to prevent vibrations and shocks from making their way from the conveying cable 20 via the support rollers 6*a* and the pivots 61 into the load-bearing structure 10, so that the load-bearing structure 10 would have to be designed suitably strengthened, those support rollers 6*a* from which the drive for the control tires 51, 52 and 53 is derived are configured with a damping element 60.

Figure 3:
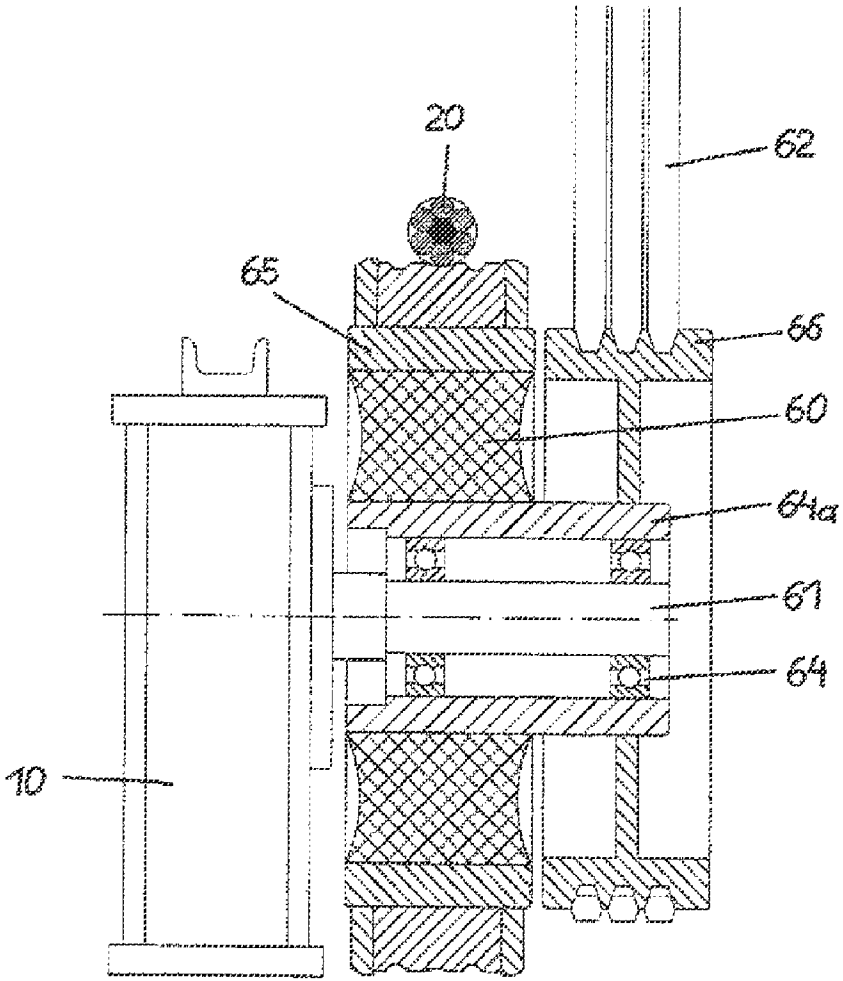
FIG. 3 shows a first embodiment of a cable roller according to the invention, in section taken along the section line II-II of FIG. 2.

In the first embodiment of a support roller 6*a*, represented in FIG. 3, the pivot 61 bears a support bearing 64, which is configured with an outer bearing ring 64*a* and by which the support roller 6*a* is rotatably mounted on the load-bearing structure 10. Furthermore, a sleeve 60 made of an elastically deformable material is provided radially outside the support bearing 64. Outside the elastic sleeve 60 there is found a support ring 65 for the conveying cable 20. Furthermore, onto the outer bearing ring 64*a* is mounted a conveying wheel 66, over which a plurality of drive belts 62 for the control tires 51, 52 and 53 are placed.

As a result of the elastic sleeve 60, vibrations and shocks which are transmitted by the conveying cable 20 are as far as possible damped, so that they do not make their way into the load-bearing structure 10.

Figure 3A:
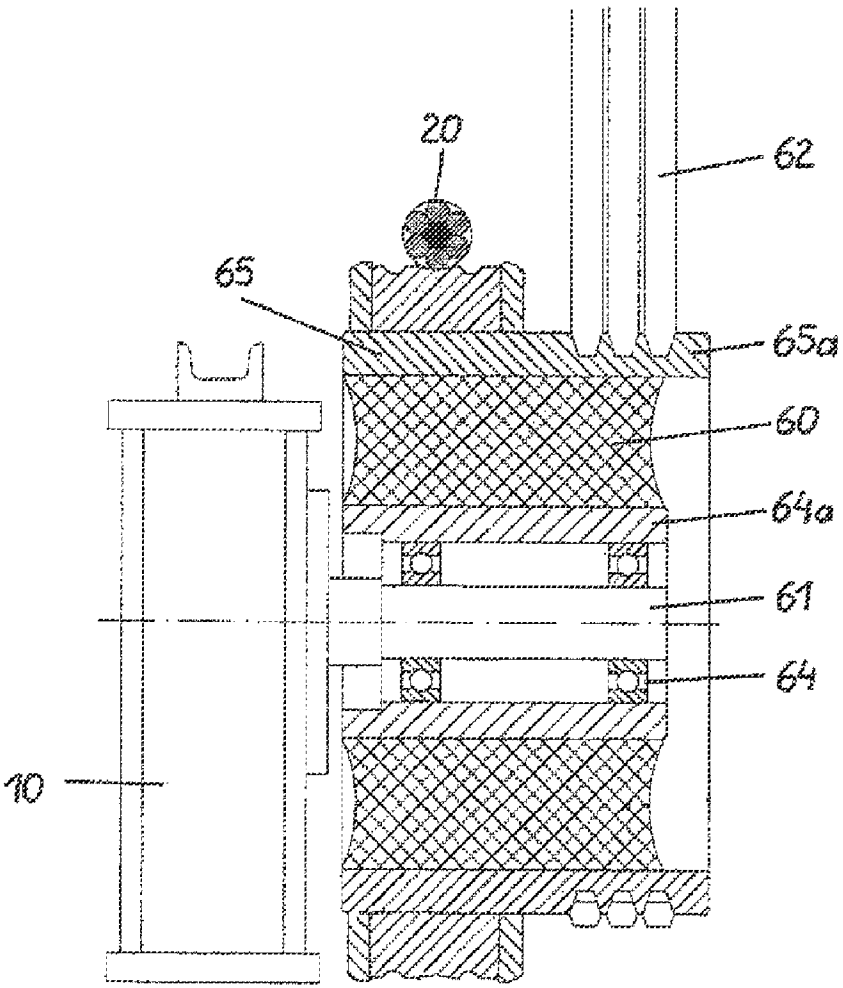
FIG. 3A shows a second embodiment of a cable roller according to the invention, in section taken along the section line II-II of FIG. 2.

The second embodiment of a support roller 6*a*, represented in FIG. 3*a*, differs from the embodiment according to FIG. 3 in that the support ring 65 for the conveying cable 20 is configured in the axial direction with an extension 65*a*, the drive belts 62 for the control tires 51, 52 and 53 being placed over this extension.

Figure 3B:
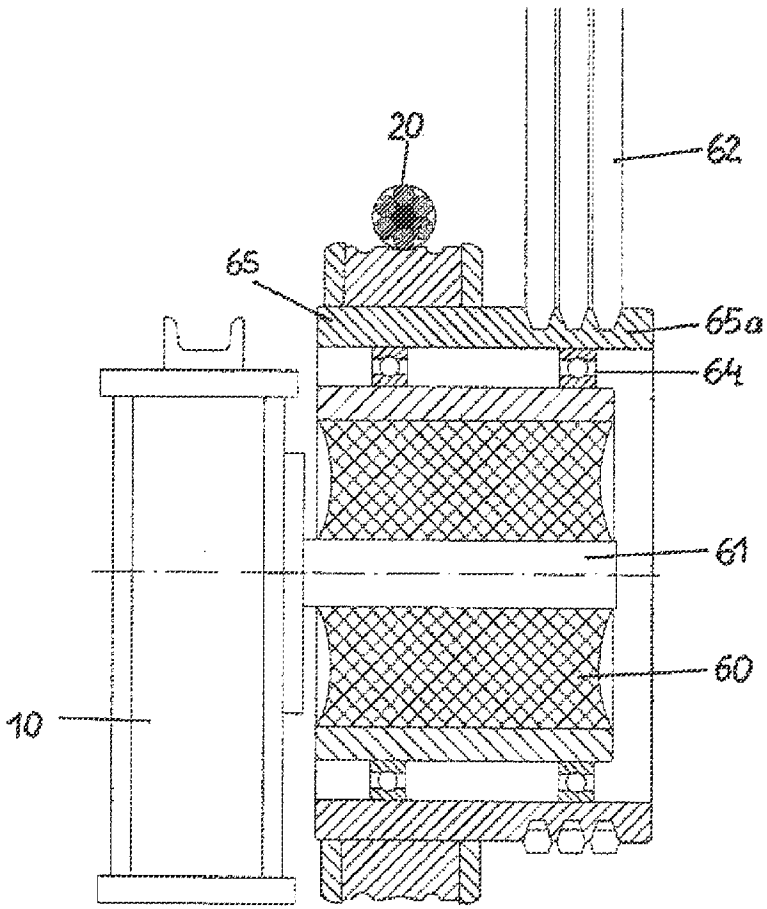
FIG. 3B shows a third embodiment of a cable roller according to the invention, in section taken along the section line II-II of FIG. 2.

The third embodiment of a support roller 6*a*, represented in FIG. 3*b*, differs from the embodiment according to FIG. 3*a* in that the elastic sleeve 60 is located between the pivot 61 and the support bearing 64. The outer bearing ring 65, which serves as the support ring for the conveying cable 20, is here configured in the axial direction with an extension 65*a*, over which the drive belts 62 for the control tires 51, 52 and 53 are placed.

Also in the embodiments according to FIG. 3*a* and FIG. 3*b*, the elastic sleeve 60 prevents vibrations and shocks transmitted by the conveying cable 20 from making their way into the load-bearing structure 10.

As is represented in FIG. 1, two support rollers 6*a*, via which the drive of the control tires 51, 52 and 53 is derived from the conveying cable 20, are provided in the cable car station. It is also possible, however, to drive the control tires 51, 52 and 53 from the conveying cable 20 via a plurality of groups of support rollers 6*a*. For this, the control tires 51, 52 and 53 can be divided into groups, which are respectively driven via separate support rollers 6*a* or groups of support rollers 6*a*. Since this drive system per se is elastic, all the control tires 51, 52 and 53 can also be drivingly coupled to one another.

In a cable railway system according to the application, the conveying cable is thus guided in the stations via support rollers 6 and 6*a*. The support rollers 6 are adjustable in height in relation to the load-bearing structure 10, by being mounted, for example, on rockers. The support rollers 6*a*, from which the movement of the control tires 51, 52 and 53 is derived, are elastically mounted on an axle rigidly fastened to the load-bearing structure 10. Vibrations and shocks caused by the conveying cable 20 are hereby prevented from making their way into the load-bearing structure 10 via the support rollers 6*a*.

The invention claimed is:

1. A cable railway system, comprising:

a conveying cable extending between two terminal stations and guided about respective headwheels in the stations;

transport vehicles each having a clamping device for coupling to said conveying cable and a running gear, wherein said vehicles are coupled to said conveying cable en route between the stations and decoupled from said conveying cable upon entering the stations;

guide rails disposed for guiding said vehicles with said running gears through the stations, for enabling passengers to disembark from and board said vehicles, and whereupon said vehicles are once more coupled to said conveying cable for exiting the respective station;

a plurality of control tires disposed in said stations effecting a movement of said vehicles in the stations, said control tires including decelerating tires, conveying tires, and accelerating tires, drivingly coupled to one another by gear mechanisms and disposed such that a speed of said vehicles, after having been decoupled from said conveying cable, is reduced by said decelerating tires, said vehicles are moved by said conveying tires at a relatively low speed through an embarkation and disembarkation area for the passengers, and the speed of said vehicles is increased by said accelerating tires, whereupon said vehicles are reconnected to said conveying cable; and a support roller disposed to support said conveying cable at the station and at least one drive belt connected between said support roller and said control tires for driving said control tires, said support roller being mounted on a rigidly fastened axle, and including a sleeve of elastically deformable material disposed between said support roller and said rigidly fastened axle.

2. The cable railway system according to claim 1, which comprises an elastic sleeve disposed between a ring bearing, disposed on a pivot, and a support ring for said conveying cable.

3. The cable railway system according to claim 2, wherein an outer bearing ring of said ring bearing is configured with a supporting surface for said at least one drive belt.

4. The cable railway system according to claim 2, wherein said support ring for said conveying cable is formed with a continuation over which said at least one drive belt is placed.

5. The cable railway system according to claim 1, which comprises an annular sleeve of elastic material mounted on a pivot fastened to a load-bearing structure in the station, and wherein a support bearing and a support ring for said conveying cable and for said at least one drive belt are disposed radially outside said annular sleeve.

6. A cable railway system, comprising:

a conveying cable extending between two terminal stations and guided about respective headwheels in the stations;

transport vehicles each having a clamping device for coupling to said conveying cable and a running gear, wherein said vehicles are coupled to said conveying cable en route between the stations and decoupled from said conveying cable upon entering the stations;

guide rails disposed for guiding said vehicles with said running gears through the stations, for enabling passengers to disembark from and board said vehicles, and whereupon said vehicles are once more coupled to said conveying cable for exiting the respective station;

a plurality of control tires disposed in said stations effecting a movement of said vehicles in the stations, said control tires including decelerating tires, conveying tires, and accelerating tires, drivingly coupled to one another by gear mechanisms and disposed such that a speed of said vehicles, after having been decoupled from said conveying cable, is reduced by said decelerating tires, said vehicles are moved by said conveying tires at a relatively low speed through an embarkation and disembarkation area for the passengers, and the speed of said vehicles is increased by said accelerating tires, whereupon said vehicles are reconnected to said conveying cable; and a support roller disposed to support said conveying cable at the station and at least one drive belt connected between said support roller and said control tires for driving said control tires;

said support roller having a ring bearing rotatably mounted to a rigidly fastened axle, a support ring for supporting said conveying cable, and an elastic sleeve disposed between said ring bearing and said support ring.

7. The cable railway system according to claim 6, wherein an outer bearing ring of said ring bearing is configured with a supporting surface for said at least one drive belt.

8. The cable railway system according to claim 6, wherein said support ring for said conveying cable is formed with a continuation over which said at least one drive belt is placed.

9. A cable railway system, comprising:

a conveying cable extending between two terminal stations and guided about respective headwheels in the stations;

transport vehicles each having a clamping device for coupling to said conveying cable and a running gear, wherein said vehicles are coupled to said conveying cable en route between the stations and decoupled from said conveying cable upon entering the stations;

guide rails disposed for guiding said vehicles with said running gears through the stations, for enabling passengers to disembark from and board said vehicles, and whereupon said vehicles are once more coupled to said conveying cable for exiting the respective station;

a plurality of control tires disposed in said stations effecting a movement of said vehicles in the stations, said control tires including decelerating tires, conveying tires, and accelerating tires, drivingly coupled to one another by gear mechanisms and disposed such that a speed of said vehicles, after having been decoupled from said conveying cable, is reduced by said decelerating tires, said vehicles are moved by said conveying tires at a relatively low speed through an embarkation and disembarkation area for the passengers, and the speed of said vehicles is increased by said accelerating tires, whereupon said vehicles are reconnected to said conveying cable; and a support roller disposed to support said conveying cable at the station and at least one drive belt connected between said support roller and said control tires for driving said control tires, and an annular sleeve of elastic material mounted on a pivot fastened to a load-bearing structure in the station, and wherein a support bearing and a support ring for said conveying cable and for said at least one drive belt are disposed radially outside said annular sleeve.

* * * * *